US008826890B2

(12) United States Patent
Sato

(10) Patent No.: US 8,826,890 B2
(45) Date of Patent: Sep. 9, 2014

(54) FUEL INJECTION VALVE MOUNTING STRUCTURE

(75) Inventor: Kazuhiko Sato, Kakuda (JP)

(73) Assignee: Keihin Corporation, Tokyo (JP)

( * ) Notice: Subject to any disclaimer, the term of this patent is extended or adjusted under 35 U.S.C. 154(b) by 505 days.

(21) Appl. No.: 13/259,279

(22) PCT Filed: May 21, 2010

(86) PCT No.: PCT/JP2010/058605

§ 371 (c)(1),
(2), (4) Date: Oct. 18, 2011

(87) PCT Pub. No.: WO2010/137526

PCT Pub. Date: Dec. 2, 2010

(65) Prior Publication Data

US 2012/0060798 A1 Mar. 15, 2012

(30) Foreign Application Priority Data

May 29, 2009 (JP) ..... 2009-129912

(51) Int. Cl.

| | |
|---|---|
| ***F02M 61/14*** | (2006.01) |
| ***F02M 55/02*** | (2006.01) |
| *F02M 69/46* | (2006.01) |
| *F02M 51/06* | (2006.01) |

(52) U.S. Cl.

CPC ..... *F02M 61/145* (2013.01); *F02M 2200/852* (2013.01); *F02M 69/465* (2013.01); *F02M 51/061* (2013.01); *F02M 2200/855* (2013.01); *F02M 55/02* (2013.01)

USPC ..... 123/470

(58) Field of Classification Search

CPC ..... F02M 61/14; F02M 2200/852; F02M 2200/855; F02M 51/005

USPC ..... 123/470, 472, 456, 468, 469

See application file for complete search history.

(56) References Cited

U.S. PATENT DOCUMENTS 5,943,995 A * 8/1999 Niwa et al. ..... 123/470

(Continued)

FOREIGN PATENT DOCUMENTS

| | | |
|---|---|---|
| CN | 1222954 A | 7/1999 |
| CN | 1532398 A | 9/2004 |
| EP | 1 793 122 A1 | 6/2007 |

(Continued)

OTHER PUBLICATIONS

Supplementary European Search Report issued in corresponding EP patent application 10 78 0481, the date of completion Feb. 28, 2014.

*Primary Examiner* — Thomas Moulis
*Assistant Examiner* — Elizabeth Hadley
(74) *Attorney, Agent, or Firm* — Carrier Blackman & Associates, P.C.; Joseph P. Carrier; Fulchand P. Shende

(57) ABSTRACT

A covering body (10) made of a synthetic resin and including a rear shoulder part (16) oriented toward a fuel inlet part (6) side is formed around an outer periphery of an intermediate portion in an axial direction of a fuel injection valve (I). The rear shoulder part (16) includes: a first semicircular shoulder part (16*a*) extending over a half periphery of the covering body (10); a second semicircular shoulder part (16*b*) shifted in the axial direction with respect to the first semicircular shoulder part (16*a*) and extending over the other half periphery of the covering body (10); and a standing wall (16*c*) standing to connect the first and second semicircular shoulder parts (16*a*, 16*b*). On a front end of a fuel supply cap (20), a semicircular holding surface (28*b*) holding at least one of the first and second semicircular shoulder parts (16*a*, 16*b*) to prevent the fuel injection valve (I) from being fallen off from the mounting hole (2), and a rotation stopper surface (28*c*) abutting against the standing wall (16*c*) to prevent rotation of the fuel injection valve (I) are formed. Accordingly, it is possible to provide a fuel injection valve mounting structure including positioning means capable of firmly restricting an orientation of a coupler in a given direction without forming projections on a fuel injection valve and a fuel supply cap.

6 Claims, 4 Drawing Sheets

(56) References Cited

U.S. PATENT DOCUMENTS

| | | | | |
|---|---|---|---|---|
| 6,116,219 | A | 9/2000 | Girard | |
| 6,223,727 | B1 * | 5/2001 | Tahara et al. | 123/470 |
| 6,640,784 | B1 | 11/2003 | Sims, Jr. | |
| 7,168,638 | B2 | 1/2007 | Saito et al. | |
| 2006/0137659 | A1 | 6/2006 | Zdroik et al. | |
| 2010/0313851 | A1 * | 12/2010 | Di Domizio et al. | 123/470 |
| 2012/0031996 | A1 * | 2/2012 | Harvey et al. | 239/289 |
| 2013/0333669 | A1 * | 12/2013 | Kromer et al. | 123/456 |

FOREIGN PATENT DOCUMENTS

| | | | |
|---|---|---|---|
| JP | 60-173675 | U | 11/1985 |
| JP | 2535132 | Y2 | 5/1997 |
| JP | 10-30528 | A | 2/1998 |
| JP | 2003-56527 | A | 2/2003 |
| JP | 2004-339992 | A | 12/2004 |
| JP | 2006-266131 | A | 10/2006 |
| JP | 2007-107420 | A | 4/2007 |
| WO | 2007/073456 | A1 | 6/2007 |

* cited by examiner

FUEL INJECTION VALVE MOUNTING STRUCTURE

TECHNICAL FIELD

The present invention relates to an improvement of a fuel injection valve mounting structure in which: a fuel injection part located at a front end of a fuel injection valve is fitted into a mounting hole of an engine, the fuel injection valve including a coupler on an intermediate portion thereof in an axial direction; a fuel supply cap provided in a retaining member is fitted onto an outer periphery of a fuel inlet part located at a rear end of the fuel injection valve, the retaining member being fixed to the engine; and positioning means for restricting an orientation of the coupler in a given direction is provided between the retaining member and the fuel injection valve.

BACKGROUND ART

Such a fuel injection valve mounting structure has already been known as disclosed in, for example, Patent Document 1 below.

PRIOR ART DOCUMENT

Patent Document

Patent Document 1: Japanese Utility Model Application Laid-open No. 60-173675

DISCLOSURE OF INVENTION

Problems to be Solved by the Invention

In the fuel injection valve mounting structure disclosed in the above Patent Document 1, positioning means for restricting an orientation of a coupler in a given direction comprises: a pair of flat surfaces formed on an opposite side surfaces of an intermediate portion of a fuel injection valve and extending in parallel with each other; and a pair of sandwiching pieces formed on a fuel supply cap so as to abut against these flat surfaces. Accordingly, the sandwiching pieces project outward of the fuel supply cap, thereby leading to the deterioration of the appearance. Moreover, the sandwiching pieces need to be thickly formed so as to enhance the strength of the positioning means. This leads to problems, such as the surrounding of the fuel supply cap being large-sized.

The present invention has been accomplished in the light of the above-mentioned circumstances, and it is an object thereof to provide a fuel injection valve mounting structure including positioning means capable of firmly restricting an orientation of a coupler in a given direction without forming projections on a fuel injection valve and a fuel supply cap.

Means for Solving the Problems

In order to attain the above object, according to a first aspect of the present invention, there is provided a fuel injection valve mounting structure in which: a fuel injection part located at a front end of a fuel injection valve is fitted into a mounting hole of an engine, the fuel injection valve including a coupler on an intermediate portion thereof in an axial direction; a fuel supply cap provided in a retaining member is fitted onto an outer periphery of a fuel inlet part located at a rear end of the fuel injection valve, the retaining member being fixed to the engine; and positioning means for restricting an orientation of the coupler in a given direction is provided between the retaining member and the fuel injection valve, characterized in that a covering body made of a synthetic resin and being integral with the coupler is formed around an outer periphery of an intermediate portion in the axial direction of the fuel injection valve, the covering body including a rear shoulder part oriented toward the fuel inlet part side, the rear shoulder part includes: a first semicircular shoulder part extending over a half periphery of the covering body; a second semicircular shoulder part shifted in the axial direction with respect to the first semicircular shoulder part and extending over the other half periphery of the covering body; and a standing wall standing to connect the first and second semicircular shoulder parts, and a semicircular holding surface and a rotation stopper surface are formed on a front end of the fuel supply cap, the holding surface holding at least one of the first and second semicircular shoulder parts to prevent the fuel injection valve from being fallen off from the mounting hole, the rotation stopper surface standing from the holding surface to abut against the standing wall and thereby forming the positioning means. Here, the above holding surface corresponds to a second semicircular end surface 28*b* in an embodiment of the present invention, which will be described later.

Further, according to a second aspect of the present invention, in addition to the first aspect, the second semicircular shoulder part is disposed frontward of the first semicircular shoulder part, and the holding surface holding the second semicircular shoulder part is formed on the fuel supply cap.

Moreover, according to a third aspect of the present invention, in addition to the second aspect, the first semicircular shoulder part is disposed adjacent to the coupler in a same phase.

Furthermore, according to a fourth aspect of the present invention, in addition to any one of the first to third aspects, the engine is a single-cylinder engine, and the retaining member has a fuel joint connecting a fuel conduit.

Effects of the Invention

In accordance with the first aspect of the present invention, the positioning means is formed by abutting the standing wall connecting between the first and second semicircular shoulder parts, which are formed on the synthetic resin covering body of the fuel injection valve, and the rotation stopper surface formed on the front end of the fuel supply cap of the retaining member. Accordingly, the orientation of the coupler can be restricted in the given direction without forming projections on the fuel injection valve and the fuel supply cap. Furthermore, since each of the half peripheral parts of the covering body and the fuel supply cap receives the load in the rotational direction applied to the positioning means, it is possible to effectively enhance the strength of the positioning means. Accordingly, it is possible to form the fuel injection valve mounting structure in a smaller size, to make the appearance more favorable, and to have stronger strength.

In accordance with the second aspect of the present invention, it is possible to maximize the area where the rotation stopper surface abuts against the standing wall to further enhance the strength of the positioning means.

In accordance with the third aspect of the present invention, it is possible to dispose the coupler and the fuel supply cap adjacent to each other, thereby contributing further size-reduction of the fuel injection valve mounting structure.

In accordance with the fourth aspect of the present invention, it is possible to provide the fuel injection valve mounting structure having a good appearance and made in a smaller size preferable for a single-cylinder engine.

EXPLANATION OF REFERENCE NUMERALS AND SYMBOLS

Figure 1:
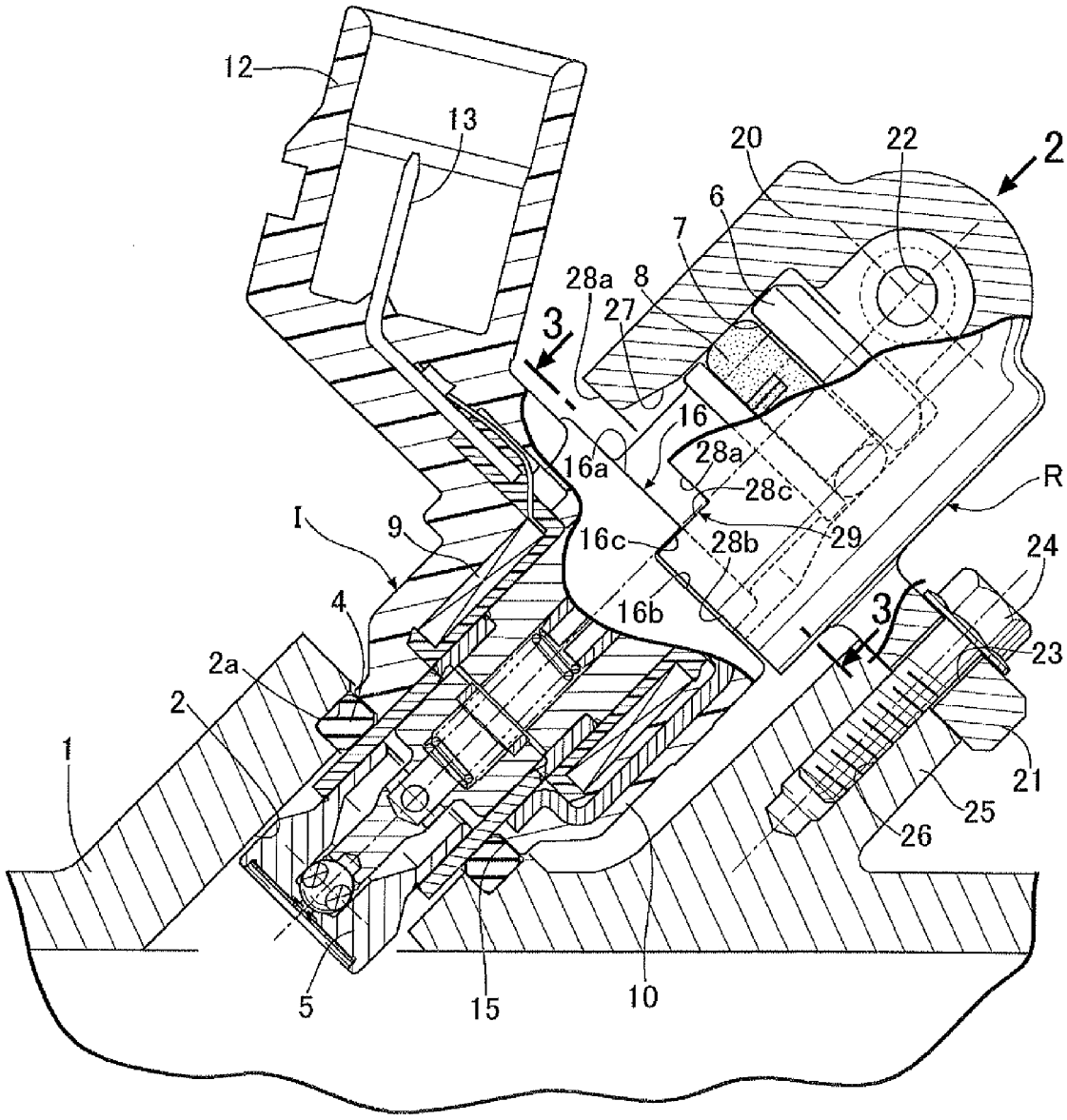
FIG. 1 is a plan view showing a state in which a fuel injection valve is mounted on an engine by use of a mounting structure of the present invention. (first embodiment)

I . . . Fuel injection valve
R . . . Retaining member
2 . . . Mounting hole
5 . . . Fuel injection part
6 . . . Fuel inlet part
10 . . . Covering body
12 . . . Coupler
16 . . . Rear shoulder part
16*a* . . . . First semicircular shoulder part
16*b* . . . . Second semicircular shoulder part
16*c* . . . . Standing wall
20 . . . Fuel supply cap
28*b* . . . . Holding surface (second semicircular end surface)
29 . . . Positioning means
30 . . . Fuel conduit

MODE FOR CARRYING OUT THE INVENTION

A mode for carrying out the present invention is explained below based on a preferred embodiment of the present invention shown in the attached drawings. Here, in the present invention, a side of a fuel injection part of an electromagnetic fuel injection valve is assumed as a front direction, and a side of a fuel inlet part thereof is assumed as a rear direction.

First Embodiment

In FIG. 1, a mounting hole 2 is provided in one side wall, located downstream of a throttle valve (not illustrated), of a throttle body 1 of a single-cylinder engine. An opening of an outer end of this mounting hole 2 is formed of an annular concave part 2*a*.

On the other hand, an electromagnetic fuel injection valve (hereinafter, simply called "fuel injection valve") I mounted to this throttle body 1 includes a fuel injection part 5 at a front end thereof and a fuel inlet part 6 at a rear end thereof. A seal member 4 is attached around an outer periphery of the base of the fuel injection part 5, and a seal member 8 is attached on a seal groove 7 formed around an outer periphery of the fuel inlet part 6.

A covering body 10 which is made of a synthetic resin and formed by molding so as to cover a coil 9 located inside thereof is formed on an outer periphery of the fuel injection valve I. On an intermediate portion in an axial direction of the covering body 10, a coupler 12 projecting laterally of the intermediate portion is integrally formed. The coupler 12 accommodates and holds a conduction terminal 13 which is continuous with the coil 9. In the covering body 10, a front shoulder part 15 oriented toward the fuel injection part 5 and a rear shoulder part 16 oriented toward the fuel inlet part 6 are formed. The fuel injection part 5 is fitted into the mounting hole 2 in such a way that the seal member 4 is pushed into the annular concave part 2*a* with the front shoulder part 15 of the covering body 10.

Figure 3:
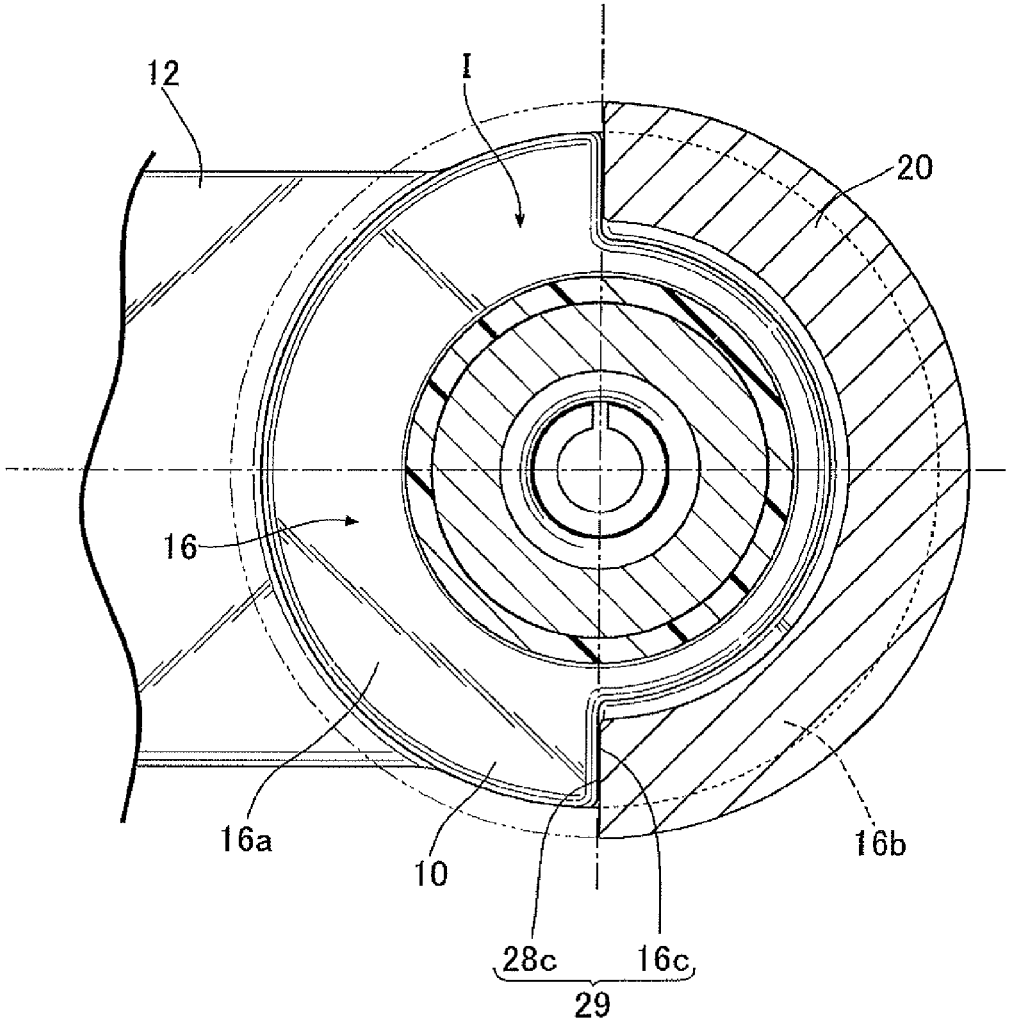
FIG. 3 is a sectional view taken along a line 3-3 in FIG. 1. (first embodiment)
Figure 4:
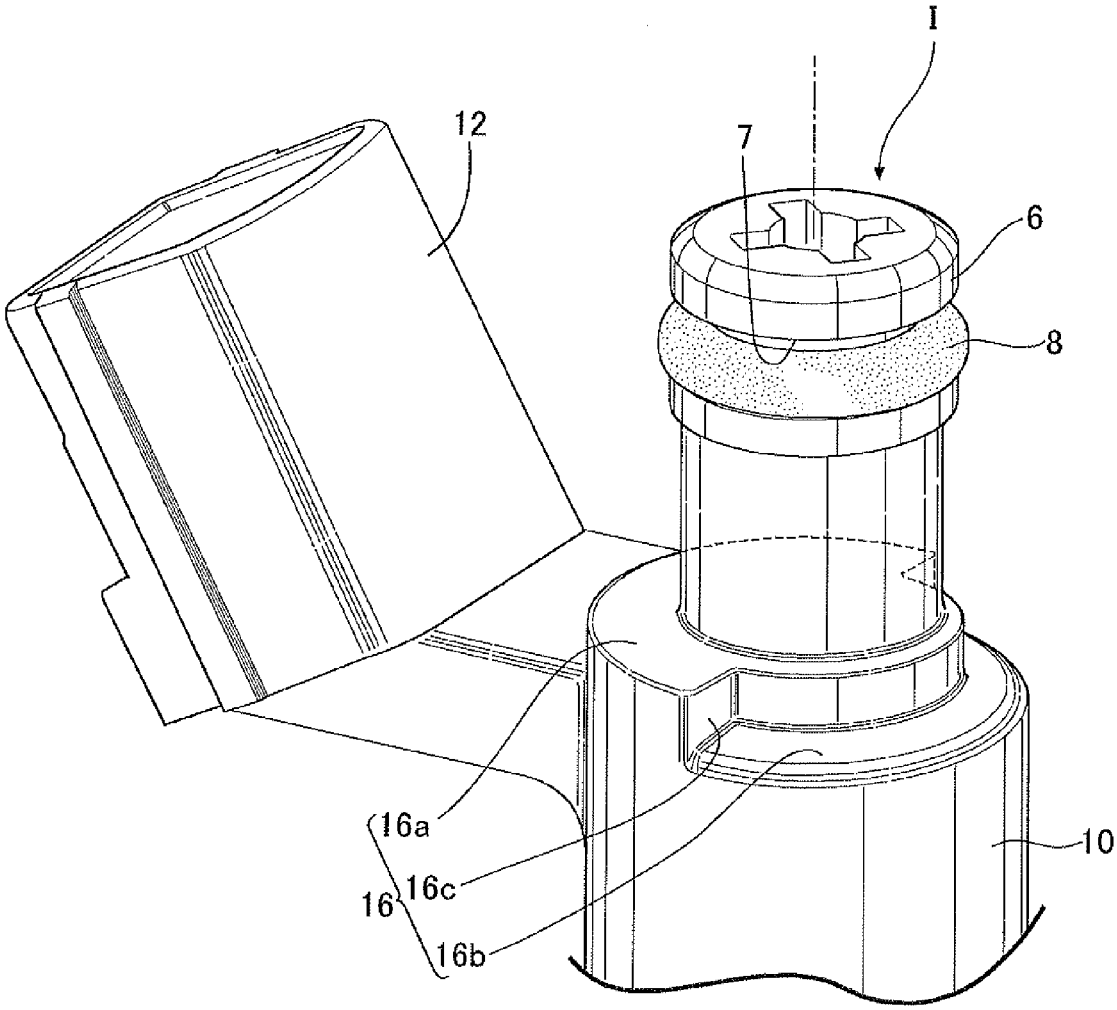
FIG. 4 is a perspective view showing an essential part of the fuel injection valve. (first embodiment)

As shown in FIGS. 1, 3 and 4, the rear shoulder part 16 comprises: a first semicircular shoulder part 16*a* extending over a half periphery of the covering body 10; a second semicircular shoulder part 16*b* shifted in the axial direction with respect to the first semicircular shoulder part 16*a* and extending over the other half periphery of the covering body 10; and a standing wall 16*c* standing so as to connect the first and second semicircular shoulder parts 16*a* and 16*b*. In this regard, the second semicircular shoulder part 16*b* is arranged frontward of the first semicircular shoulder part 16*a* and adjacent to the coupler 12 in a same phase.

Figure 2:
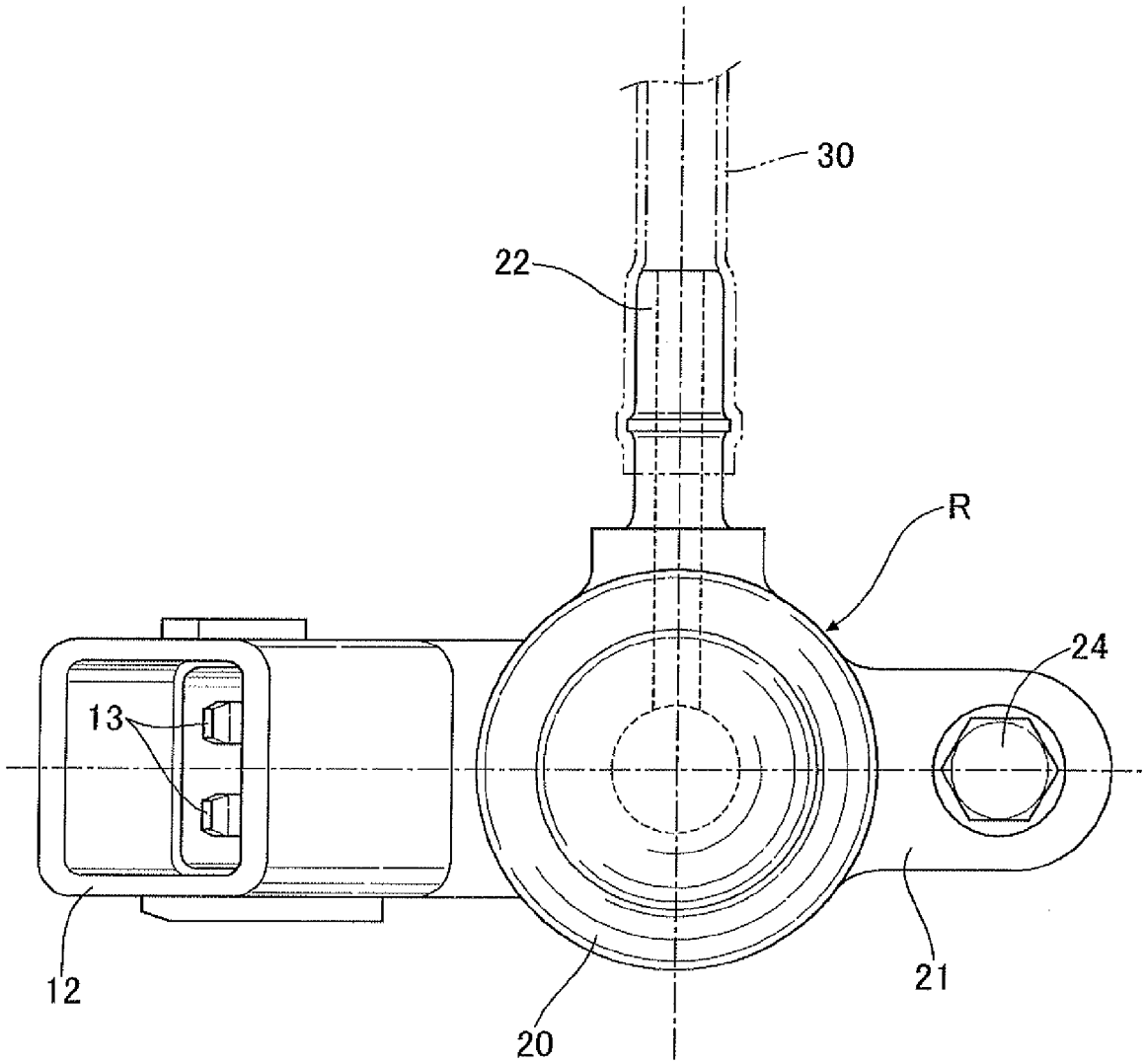
FIG. 2 is a view seen from a direction of an arrow 2 in FIG. 1. (first embodiment)

As shown in FIGS. 1 and 2, a retaining member R made of a synthetic resin is prepared in order to retain the fuel injection valve I in which the fuel injection part 5 is fitted into the mounting hole 2 as well as to supply fuel into the fuel injection valve I. The retaining member R includes a cylindrical fuel supply cap 20, a support arm 21 provided in a projecting manner on one side surface of the fuel supply cap 20, and a fuel joint 22 provided in a projecting manner on another side of the fuel supply cap 20 and communicating the fuel supply cap 20 with an inside thereof. The support arm 21 is fixedly attached to a predetermined position of the throttle body 1 by threadably screwing and fastening a bolt 24 inserted into a bolt hole 23 of the support arm 21 with a screw hole 26 of an attaching boss 25 formed on the predetermined position of the throttle body 1. A fuel conduit 30 guiding fuel discharged from a fuel pump (not illustrated) is connected to the fuel joint 22.

Again, in FIGS. 1, 3 and 4, the fuel supply cap 20 is fitted onto the outer periphery of the fuel inlet port 6 while contacting closely the seal member 8 on the inner peripheral surface of the fuel cap 20. A tapered surface 27 guiding a fitment of the fuel inlet part 6 is formed on a front opening part of the inner peripheral surface of the fuel supply cap 20.

On the front end of this fuel supply cap 20, a first semicircular end surface 28*a* extending over a half periphery of the fuel supply cap 20, a second semicircular end surface 28*b* projecting frontward of the first semicircular end surface 28*a* and extending over the other half periphery of the fuel supply cap 20, and a rotation stopper surface 28*c* standing to connect the first and second semicircular end surfaces 28*a* and 28*b* are formed. The fuel injection valve I is arranged in such a way that the first and second semicircular shoulder parts 16*a* and 16*b* face the first and second semicircular end surfaces 28*a* and 28*b* as well as the standing wall 16*c* abuts against the rotation stopper surface 28*c*. In this regard, in the illustrated example, the second semicircular end surface 28*b* functions as a holding surface to hold the second semicircular shoulder part 16*b* so that the fuel injection valve I is prevented from being fallen off from the mounting hole 2.

However, it is possible to make both of the first and second semicircular end surfaces 28*a* and 28*b* function as holding surfaces for the first and second semicircular shoulder parts 16*a* and 16*b*. It is effective to maximize the area where the rotation stopper surface 28*c* abuts against the standing wall 16*c* if at least the semicircular end surface 28*b* functions as a holding surface.

For the above reasons, the rotation stopper surface 28*c* and the standing wall 16*c* form positioning means 29 for restricting the orientation of the coupler 12 of the fuel injection valve I in a given direction by abutting against each other.

Next, operations of this embodiment will be described.

When the fuel injection valve I is mounted to the throttle body 1, at first, the fuel injection part 5 of the fuel injection valve I is fitted into the mounting hole 2 of the throttle body 1 and the seal member 4 is pushed into the annular concave part 2*a* with the front shoulder part 15 of the covering body 10, so that the surrounding of the fuel injection part 5 is sealed.

Subsequently, the first and second semicircular end surfaces 28*a* and 28*b* of the fuel supply cap 20 of the retaining member R is made to face the first and second semicircular shoulder parts 16*a* and 16*b* of the fuel injection valve I, and the fuel supply cap 20 is deeply fitted onto the outer periphery of the fuel inlet part 6 of the fuel injection valve I while abutting the rotation stopper surface 28*c* against the standing wall 16*c*. Then, the second semicircular end surface 28*b* abuts against the second semicircular shoulder part 16*b* or faces the second semicircular shoulder part 16*b* with minute space interposed therebetween. In this state, the fuel supply cap 20, i.e., the retaining member R, and the fuel injection valve I are connected in the rotational direction via the rotation stopper surface 28*c* and the standing wall 16*c*, which abut against each other. In this state, the retaining member R is appropriately rotated so that the bolt hole 23 of the support arm 21 corresponds to the screw hole 26 of the throttle body 1, and, then, the bolt 24 inserted into the bolt hole 23 is threadably screwed and fastened with the screw hole 26.

Accordingly, the second semicircular end surface 28*b* holds the second semicircular shoulder part 16*b* to prevent the fuel injection valve I from being fallen off from the mounting hole 2, and the rotation stopper surface 28*c* abuts against the standing wall 16*c* to prevent the rotation of the fuel injection valve I, so that the orientation of the coupler 12 is restricted in the given direction. For this reason, a feed coupler (not illustrated) can be connected to the coupler 12 in the given direction, thereby easily performing its connection work.

As described above, the positioning means 29 is formed by abutting the standing wall 16*c* connecting between the first and second semicircular shoulder parts 16*a* and 16*b*, which are formed on the synthetic resin covering body 10 of the fuel injection valve I, and the rotation stopper surface 28*c* standing to connect the first and second semicircular end surfaces 28*a* and 28*b*, which are formed on the front end of the fuel supply cap 20 of the retaining member R. Accordingly, the orientation of the coupler can be restricted in the given direction without forming projections on the fuel injection valve I and the fuel supply cap 20. Furthermore, since each of the half peripheral parts of the covering body 10 and the fuel supply cap 20 receives the load in the rotational direction applied to the positioning means 29, it is possible to effectively enhance the strength of the positioning means 29. Accordingly, it is possible to form the fuel injection valve mounting structure in a smaller size, to make the appearance more favorable, and to have stronger strength. Particularly, in the structure according to this embodiment, it is possible to provide the fuel injection valve mounting structure having a good appearance and made in a smaller size, which is preferable for a single-cylinder engine.

Further, the second semicircular shoulder part 16*b* is disposed frontward of the first semicircular shoulder part 16*a* and the second semicircular shoulder part 16*b* is hold by the second semicircular end surface 28*b*, so that the fuel injection valve I is prevented from being fallen off from the mounting hole 2. Accordingly, it is possible to maximize the area where the rotation stopper surface 28*c* abuts against the standing wall 16*c* to further enhance the strength of the positioning means 29.

Further, since the first semicircular shoulder part 16*a* is arranged adjacent to the coupler 12 in the same phase, it is possible to arrange the coupler 12 and the fuel supply cap 20 adjacent to each other, thereby contributing further size-reduction of the fuel injection valve mounting structure.

An embodiment of the present invention is explained above, but the present invention is not limited to the embodiment and may be modified in a variety of ways as long as the modifications do not depart from its gist. For example, the mounting hole 2 may be provided in the inlet pipe of the engine. Moreover, the present invention may be applied to a multicylinder engine.

The invention claimed is:

1. A fuel injection valve mounting structure in which:

a fuel injection part located at a front end of a fuel injection valve is fitted into a mounting hole of an engine, the fuel injection valve including a coupler on an intermediate portion thereof in an axial direction;

a fuel supply cap provided in a retaining member is fitted onto an outer periphery of a fuel inlet part located at a rear end of the fuel injection valve, the retaining member being fixed to the engine; and positioning means for restricting an orientation of the coupler in a given direction is provided between the retaining member (R) and the fuel injection valve, wherein a covering body made of a synthetic resin and being integral with the coupler is formed around an outer periphery of an intermediate portion in the axial direction of the fuel injection valve, the covering body including a rear shoulder part oriented toward the fuel inlet part side, the rear shoulder part includes:

a first semicircular shoulder part extending over a half periphery of the covering body;

a second semicircular shoulder part shifted in the axial direction with respect to the first semicircular shoulder part and extending over the other half periphery of the covering body; and a standing wall standing to connect the first and second semicircular shoulder parts, and a semicircular holding surface and a rotation stopper surface are formed on a front end of the fuel supply cap, the holding surface holding at least one of the first and second semicircular shoulder parts to prevent the fuel injection valve from being fallen off from the mounting hole, the rotation stopper surface standing from the holding surface to abut against the standing wall and thereby forming the positioning means.

2. The fuel injection valve mounting structure according to claim 1, wherein the second semicircular shoulder part is disposed frontward of the first semicircular shoulder part, and the holding surface holding the second semicircular shoulder part is formed on the fuel supply cap.

3. The fuel injection valve mounting structure according to claim 2, wherein the first semicircular shoulder part is disposed adjacent to the coupler in a same phase.

4. The fuel injection valve mounting structure according to claim 1, wherein the engine is a single-cylinder engine, and the retaining member has a fuel joint connecting a fuel conduit.

5. The fuel injection valve mounting structure according to claim 2, wherein the engine is a single-cylinder engine, and the retaining member has a fuel joint connecting a fuel conduit.

6. The fuel injection valve mounting structure according to claim 3, wherein the engine is a single-cylinder engine, and the retaining member has a fuel joint connecting a fuel conduit.

* * * * *